US007665434B2

(12) United States Patent
Conti

(10) Patent No.: US 7,665,434 B2
(45) Date of Patent: Feb. 23, 2010

(54) INTERNAL COMBUSTION ENGINE WITH CONTINUOUS VARIABLE VALVE LIFT SYSTEM

(76) Inventor: Luigi Conti, Corso Galileo Galilei 34, I-10126 Torino (IT)

( * ) Notice: Subject to any disclaimer, the term of this patent is extended or adjusted under 35 U.S.C. 154(b) by 255 days.

(21) Appl. No.: 11/914,179

(22) PCT Filed: Mar. 15, 2006

(86) PCT No.: PCT/EP2006/060756

§ 371 (c)(1),
(2), (4) Date: Dec. 17, 2007

(87) PCT Pub. No.: WO2006/012005

PCT Pub. Date: Nov. 16, 2006

(65) Prior Publication Data

US 2008/0168958 A1 Jul. 17, 2008

(30) Foreign Application Priority Data

May 12, 2005 (IT) ..... TO2005A0326

(51) Int. Cl.
*F01L 1/34* (2006.01)

(52) U.S. Cl. ..... 123/90.16; 123/90.15

(58) Field of Classification Search ..... 123/90.15, 123/90.16

See application file for complete search history.

(56) References Cited

U.S. PATENT DOCUMENTS 4,526,142 A * 7/1985 Hara et al. ..... 123/90.16
5,189,998 A 3/1993 Hara

FOREIGN PATENT DOCUMENTS

DE 10303128 7/2004
EP 1331370 1/2002

(Continued)

OTHER PUBLICATIONS

International Search Report from International Application No. PCT/EP2006/060756 completed May 24, 2006, and mailed on Jun. 2, 2006.

(Continued)

*Primary Examiner*—Zelalem Eshete
(74) *Attorney, Agent, or Firm*—Heslin Rothenberg Farley & Mesiti P.C.; Victor A. Cardona, Esq.

(57) ABSTRACT

An internal combustion engine has an electronically controlled variable mechanical transmission for varying the maximum lift of intake and/or exhaust poppet valves. The mechanical transmission includes a regulator mechanism with one or more slotted holes, and an actuation mechanism. The actuation mechanism includes a primary oscillating lever in contact with a cam actuating the lift of the valve, a secondary oscillating lever directly acting on the poppet valve, and a wedge-shaped slider device. The slider device includes a bore fitted with a roller free to rotate and having its ends protruding from it. The slider is interposed between the two oscillating levers and transmits the movement from the primary oscillating lever to the secondary one. The slider actuates the variation of the poppet valve's maximum lift. The regulator mechanism modifies the angular position of the slotted holes and actuates the variation of the transmission from the cam to the poppet valve.

22 Claims, 14 Drawing Sheets

FOREIGN PATENT DOCUMENTS

Figure 1:
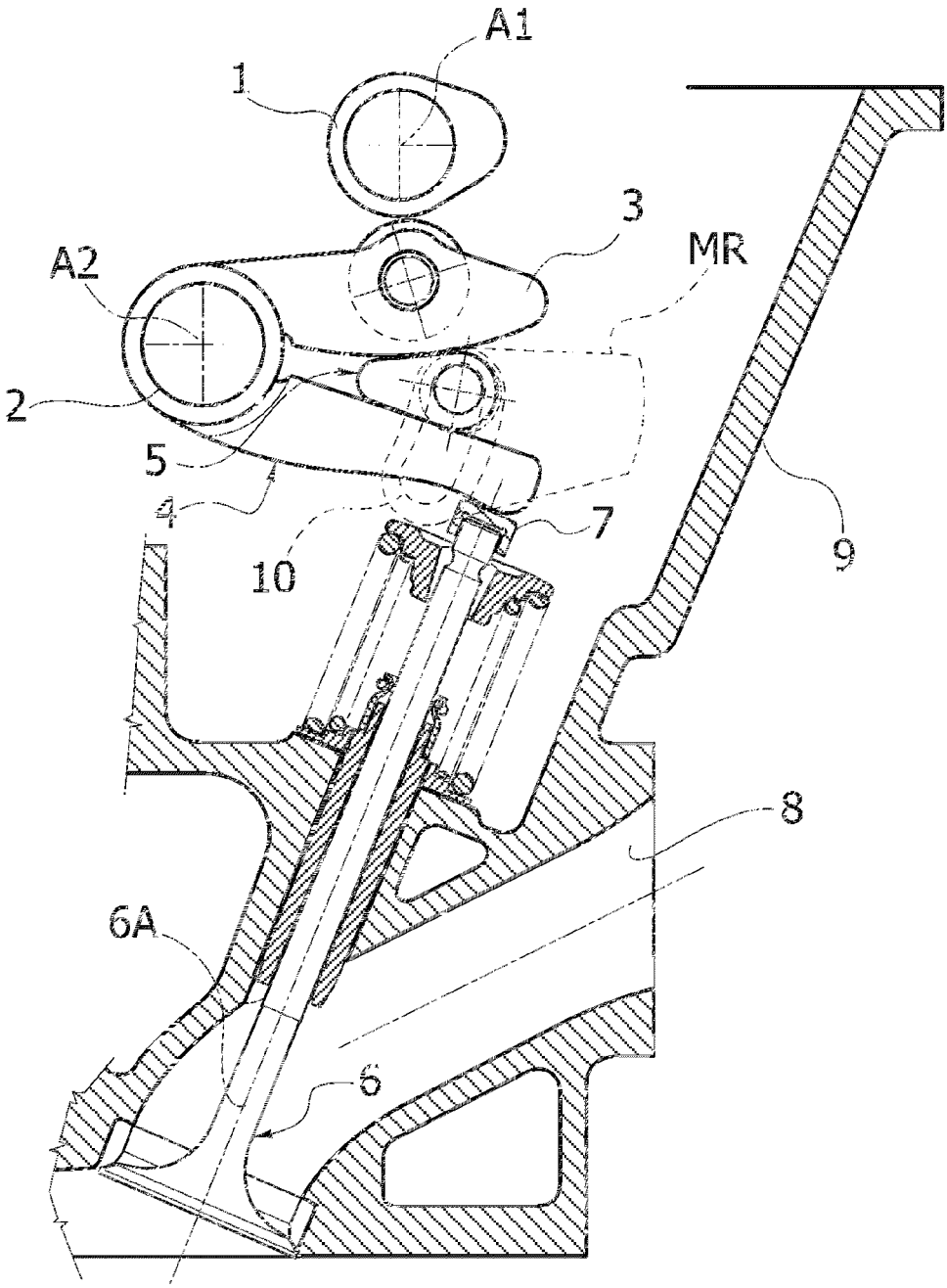

| | | |
|---|---|---|
| EP | 1484479 | 12/2004 |
| EP | 1515009 | 3/2005 |
| WO | 2004088099 | 10/2004 |
| WO | 2005026503 | 3/2005 |

OTHER PUBLICATIONS

Written Opinion of the International Searching Authority from International Application No. PCT/EP2006/060756, completed May 24, 2006, and mailed on Jun. 2, 2006.

* cited by examiner

INTERNAL COMBUSTION ENGINE WITH CONTINUOUS VARIABLE VALVE LIFT SYSTEM

CROSS REFERENCE TO RELATED APPLICATIONS

This application is a national stage of PCT International Application No. PCT/EP2006/060756 filed on Mar. 15, 2006, and published in English on Nov. 16, 2006, as WO 2006/120050, which claims priority to Italian Patent Application No. T02005A000326, filed on May 12, 2005, the entire disclosures of which are incorporated herein by reference.

The present invention relates to internal combustion engines including:

at least one cylinder, at least one air intake and at least one exhaust poppet valve for each cylinder, each of them being equipped with its own return elastic device, acting in such a way to keep the valve closed; the function of said valves being that of controlling the engine intake and exhaust processes, at least one camshaft to lift the intake and exhaust valves by acting on their tappets. Moreover, one or more valves of said engines, operated by the cams of the camshaft, are provided with electronically controlled variable mechanical transmissions, capable to vary the maximum lift of the valves depending on the working conditions of the engine.

Said electronically controlled variable actuation system includes a mechanical variable transmission, with electronic control, operating between the valve and the lifting cam.

As an example, an internal combustion engine with a variable valve lift system, of the type previously described, is illustrated and described by EP-1 039 103, DE 42 23 172 C1 and U.S. Pat. No. 5,373,818.

The valve timing gear of alternative internal combustion engines (i.e. the mechanical system including the intake and exhaust valves and the devices to lift and close them) is under development from a long time with the aim of improving both the performance and the operating flexibility.

The first most important innovation dates from the 70's when the Variable Valve Timing (VVT) was brought to production and further improved during the following years.

Such system, which is currently equipping many production cars, gives at the engine the possibility of varying the timing of the valve train through the variation of the angular position of the cam with respect to the camshaft.

The advantage from such a solution deals with the possibility of optimizing the volumetric efficiency of the engine over the full speed range, which is physically impossible with a fixed valve timing.

It may be said that all the major automotive manufacturers, OEM, are currently producing cars with VVT and many of them adopt proprietary solutions.

The possibility of realizing a Variable Valve Lift system (VVL), also defined Variable Valve Actuation (VVA), was studied for a long time, but the stage of production was reached later than VVT, due to the greater complexity.

This possibility is of great interest due to the further improvements allowed, the most important of which are the optimization of the volumetric efficiency over the speed range (like the VVT, but more effectively) and—in the case of spark ignited engines—the possibility of controlling the Air/Fuel ratio by substituting the throttle valve with the variation of the lift of the valve.

The advantage from this latter possibility has to be seen in the reduction of the "pumping losses", which means better efficiency and hence reduced fuel consumption and emissions.

Another positive aspect deals directly with the combustion process, by properly managing the lift of the intake valves, with the object of increase the speed of the air entering the combustion chamber, and hence its micro and macro turbulences at the end of the compression, which is a proved method to increase the speed of flame propagation.

Moreover, the possibility to reduce the exhaust valve lift during braking may be used as a brake assist system, which is of particular, but not exclusive, interest for Heavy Duty Diesel application (similarly—but more effectively—to the practice of using a throttle valve in the exhaust manifold).

Another application allowed by a flexible exhaust valve lift system, worth to be mentioned, is the modulation of the internal Exhaust Gas Recirculation (EGR), which may be accomplished by reducing the exhaust valve lift to keep more exhaust gases in the combustion chamber at the end of the exhaust phase. The Exhaust Gas Recirculation technique is widely used to reduce the NOx emissions, but this is normally achieved by using a by-pass system external to the engine.

By the end of the 80's the automotive manufacturer Honda put into production a line of engines equipped with the V-TEC System, capable to realize a two steps variation of the valve lift. This system, further improved through the years, is currently equipping almost all the Honda engines, most of them for automotive use, but also for non-automotive application.

Later on, other automotive manufacturers (Mitsubishi, Toyota) went to production with stepped mechanical solutions, but the most important breakthrough was performed by BMW by putting into production in 2002 the first continuous variable valve lift system (VALVETRONIC).

This is a fully mechanical solution and the lift variation is actuated by an electric engine, controlled by the combustion engine electronic control unit, according to some defined engine managing strategies.

The improvements allowed are relevant and this widely justifies the additional complexity and cost, as also testified by the recent agreement by BMW and PSA for the common production of a new line of medium-small capacity engines incorporating the VALVETRONIC system.

Other VVL systems are under study and among them the electro-hydraulic solutions are worth to be mentioned. These, for some aspects, seem to be an evolution of some hydraulic lash compensators, widely used to keep constantly equal to zero the working clearance of the valve-train.

Some automotive OEM's and Research Centres are also developing the so-called "cam-less" solutions, which avoid the use of the camshaft by substituting it with actuators based on electromagnetic or hydraulic devices.

Looking at all the solutions already in production or under development it may be concluded that probably the VVL system could be considered one of the most promising—if not the most promising—evolutions of internal combustion engines in recent times.

The object of the present invention is to provide an internal combustion engine equipped with a variable valve lift control system of the type described at the beginning of the present description, including a variable mechanical transmission, characterized by a noteworthy conceptual simplicity and by high efficiency and reliability as well.

According to the present invention, that object is achieved by means of an internal combustion engine, as indicated at the beginning of this description, with a mechanical variable transmission including:

a regulation element equipped with at least one slotted holes, a primary oscillating lever (the one being also designated as "finger follower", according to the usual engine nomenclature), directly actuated by a cam, a secondary oscillating lever, directly acting on the valve, a wedge-shaped slider device, with a bore fitted with a roller free to rotate and having its ends protruding from it; the ends of said roller being engaged and guided by the slotted holes of the regulator mechanism; said slider is interposed between the two oscillating levers and transmits the movement from the primary oscillating lever to the secondary one; said slider, by sliding back and forth during the poppet valve lift, actuates—depending on the rotation of the regulator mechanism—the variation of the valve maximum lift.

driving elements to operate the regulation mechanism and its slotted holes, in order to shift the position of the slider with respect to the primary and secondary oscillating levers, getting in such a way the variation of the transmission characteristic from the cam to the valve.

Figure 2:
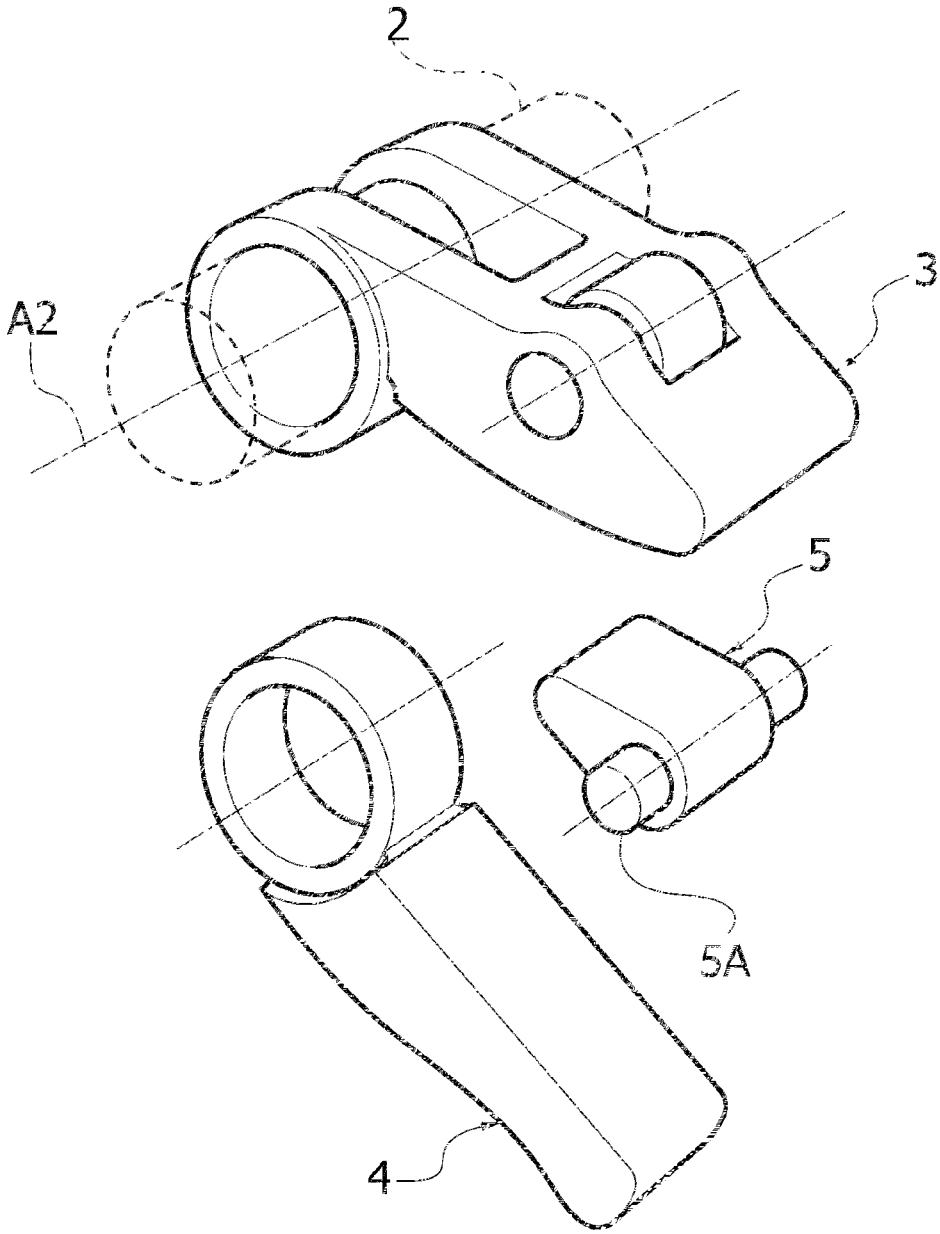
Figure 3:
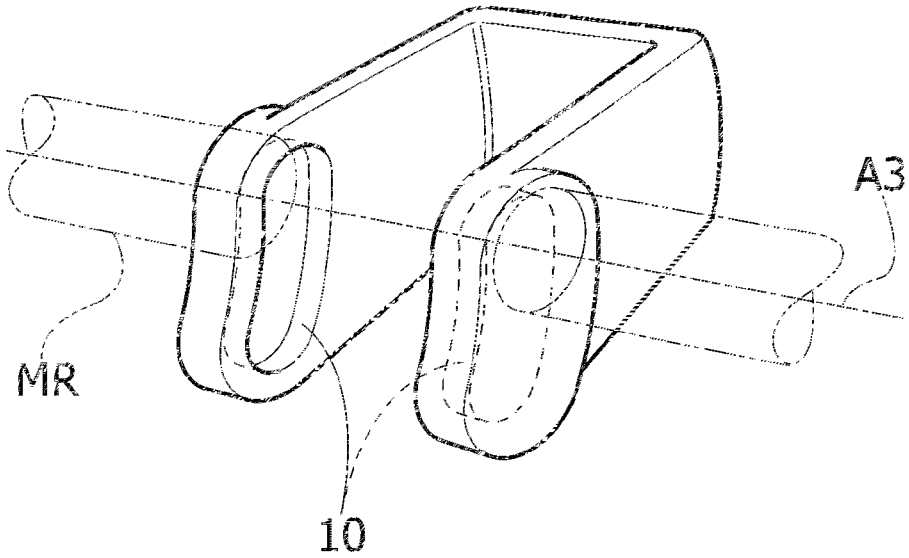
Figure 3:
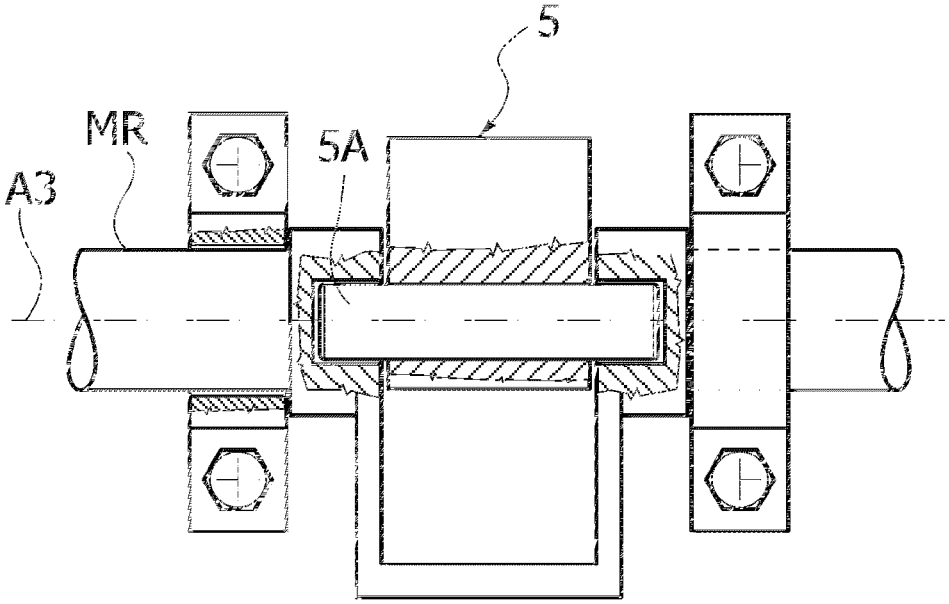
Figure 4:
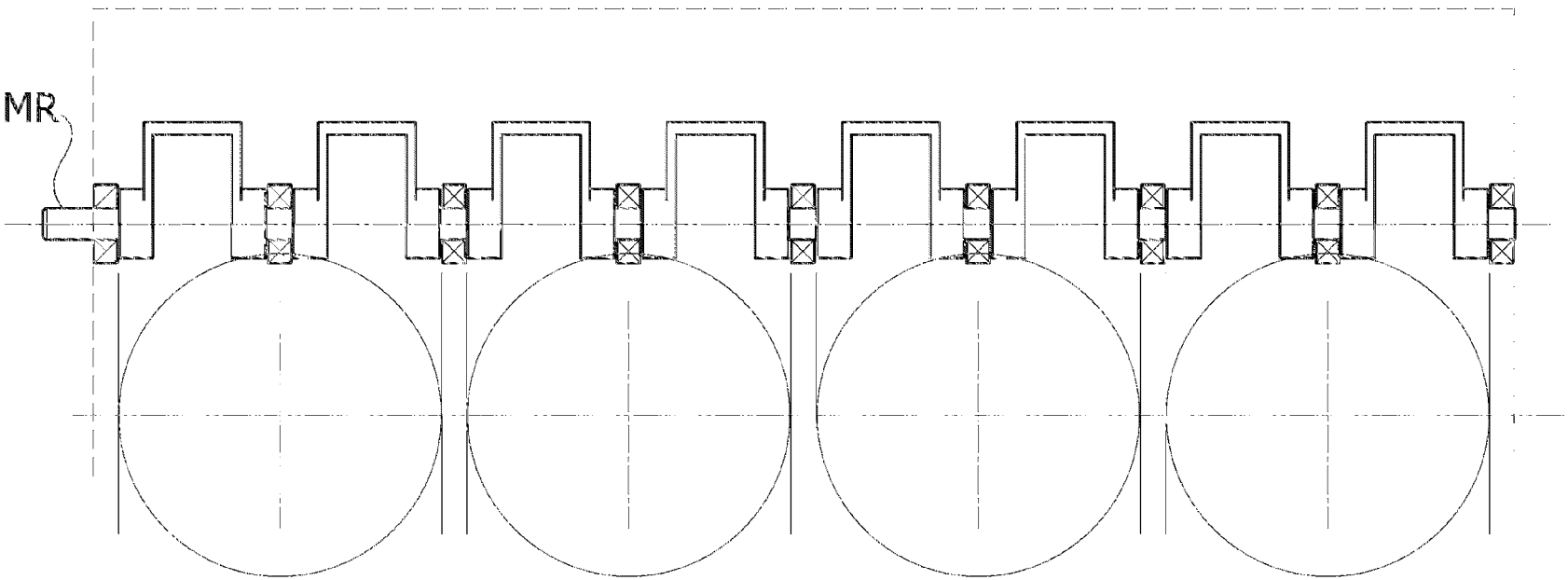
Figure 5:
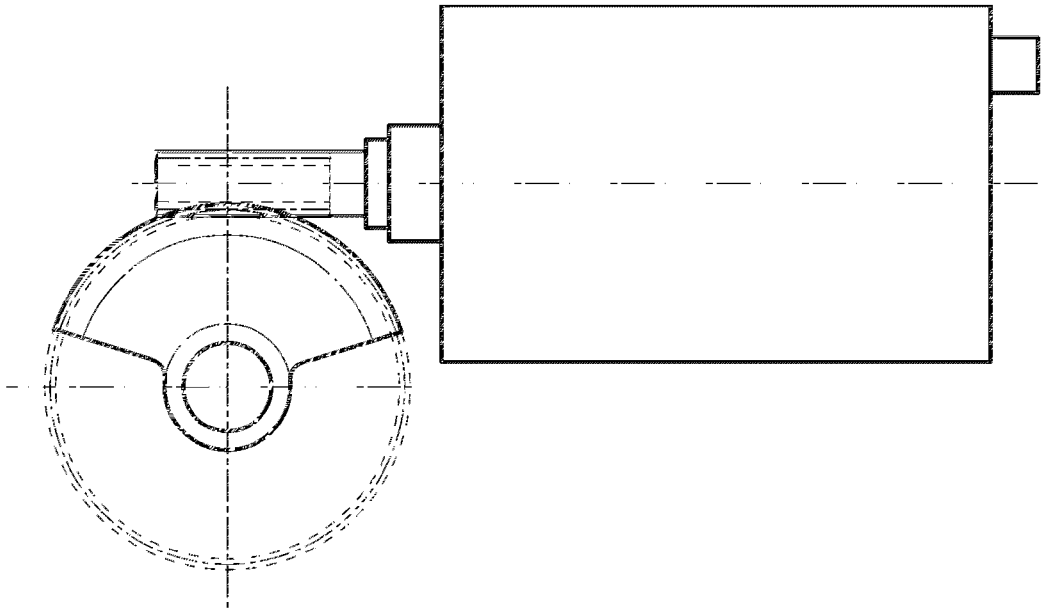
Figure 6:
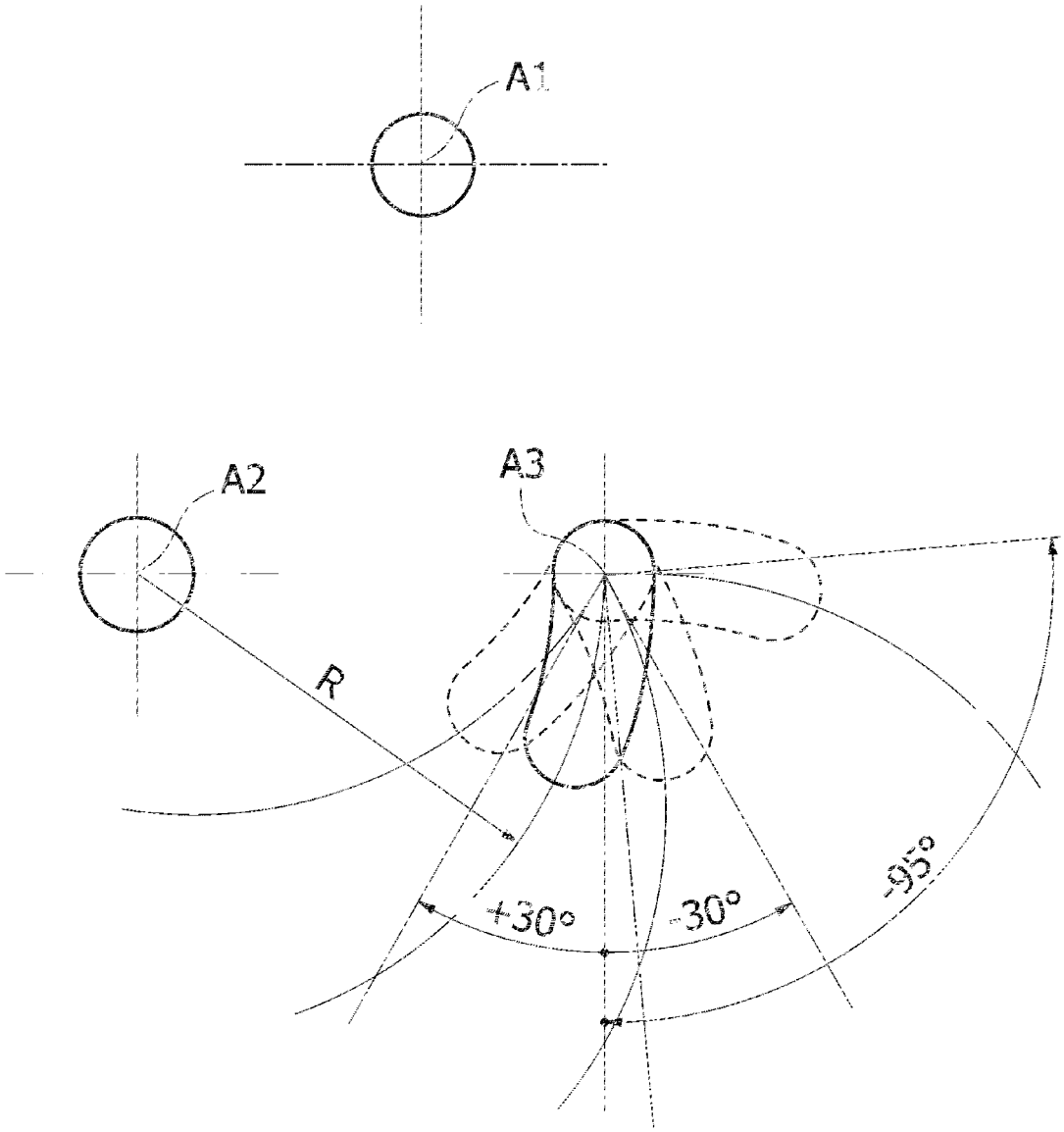
Figure 10:
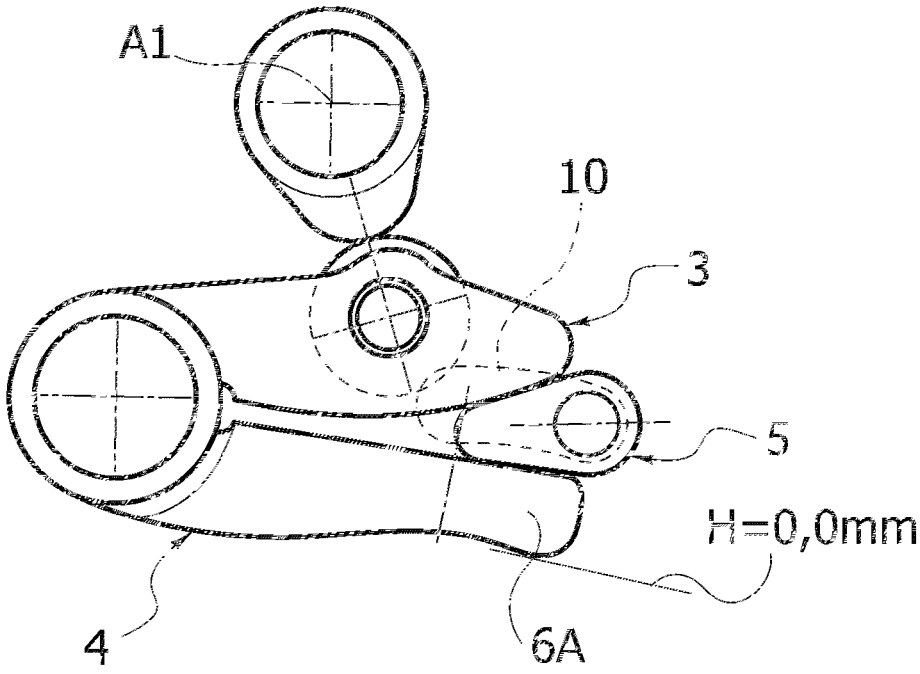
Figure 11:
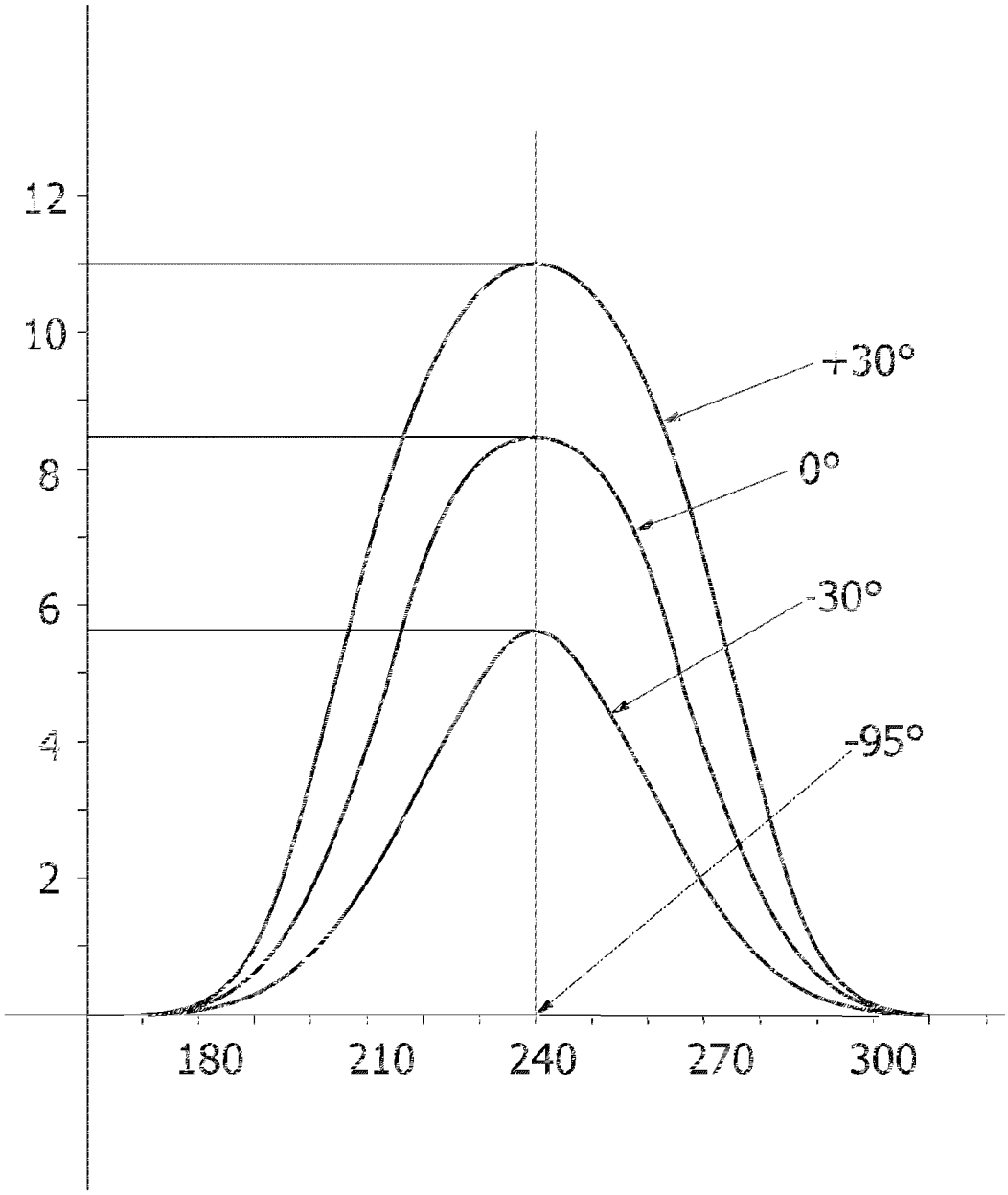
Figure 12:
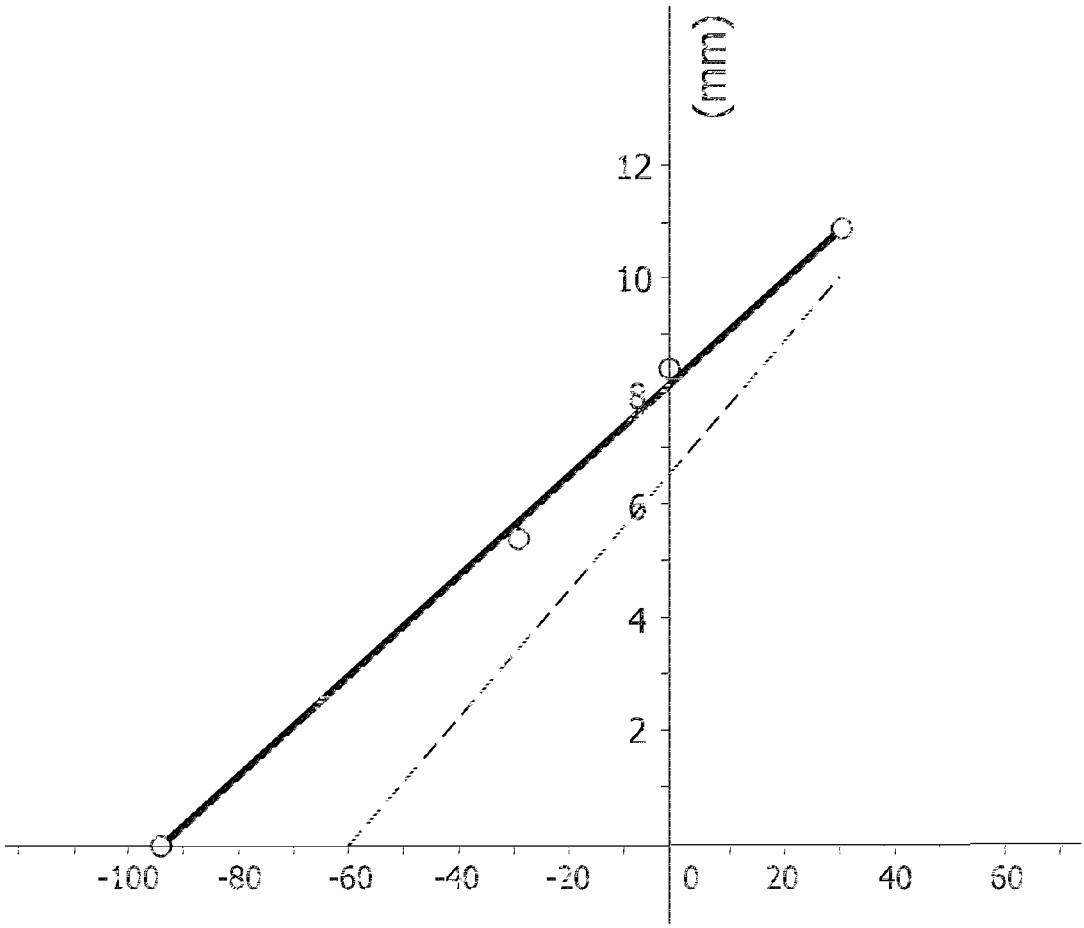
Figure 13:
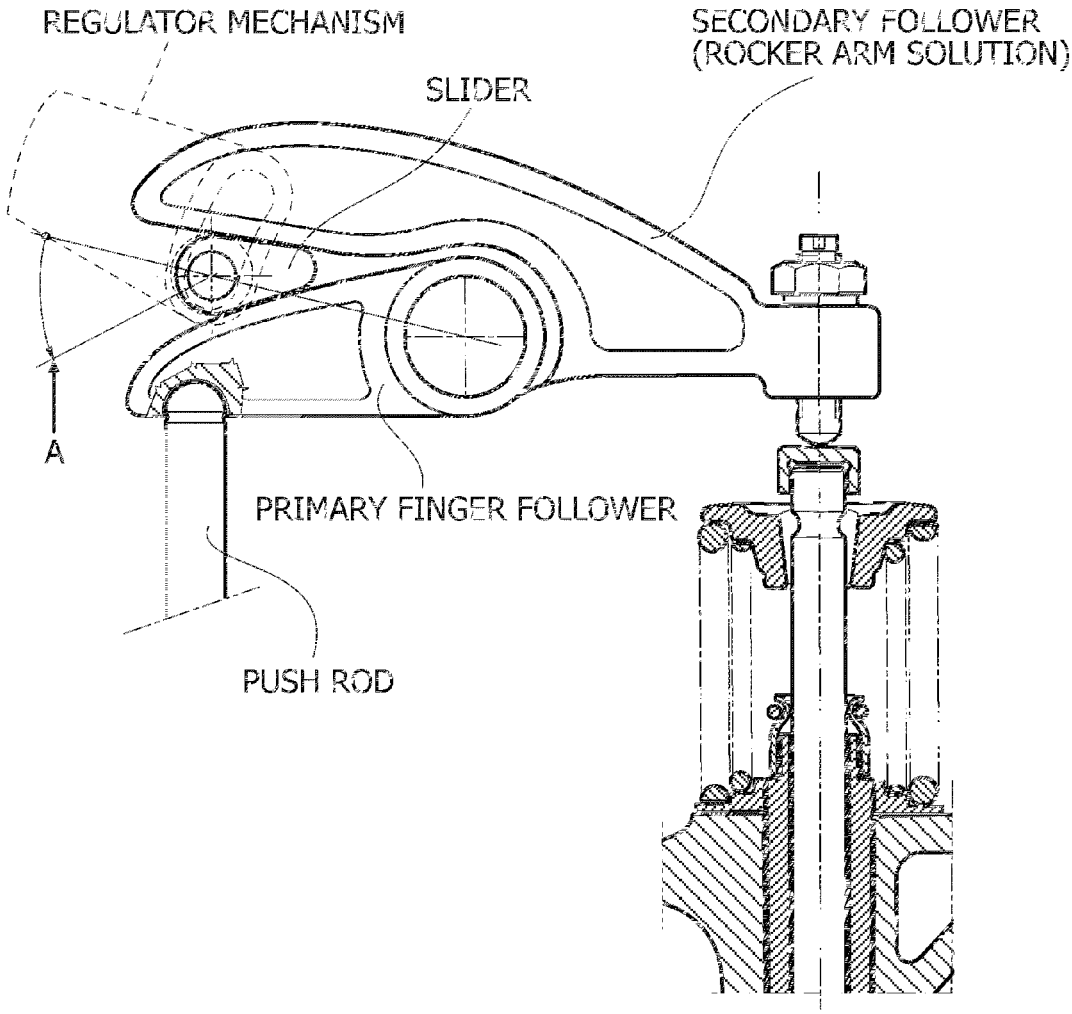
Figure 14:
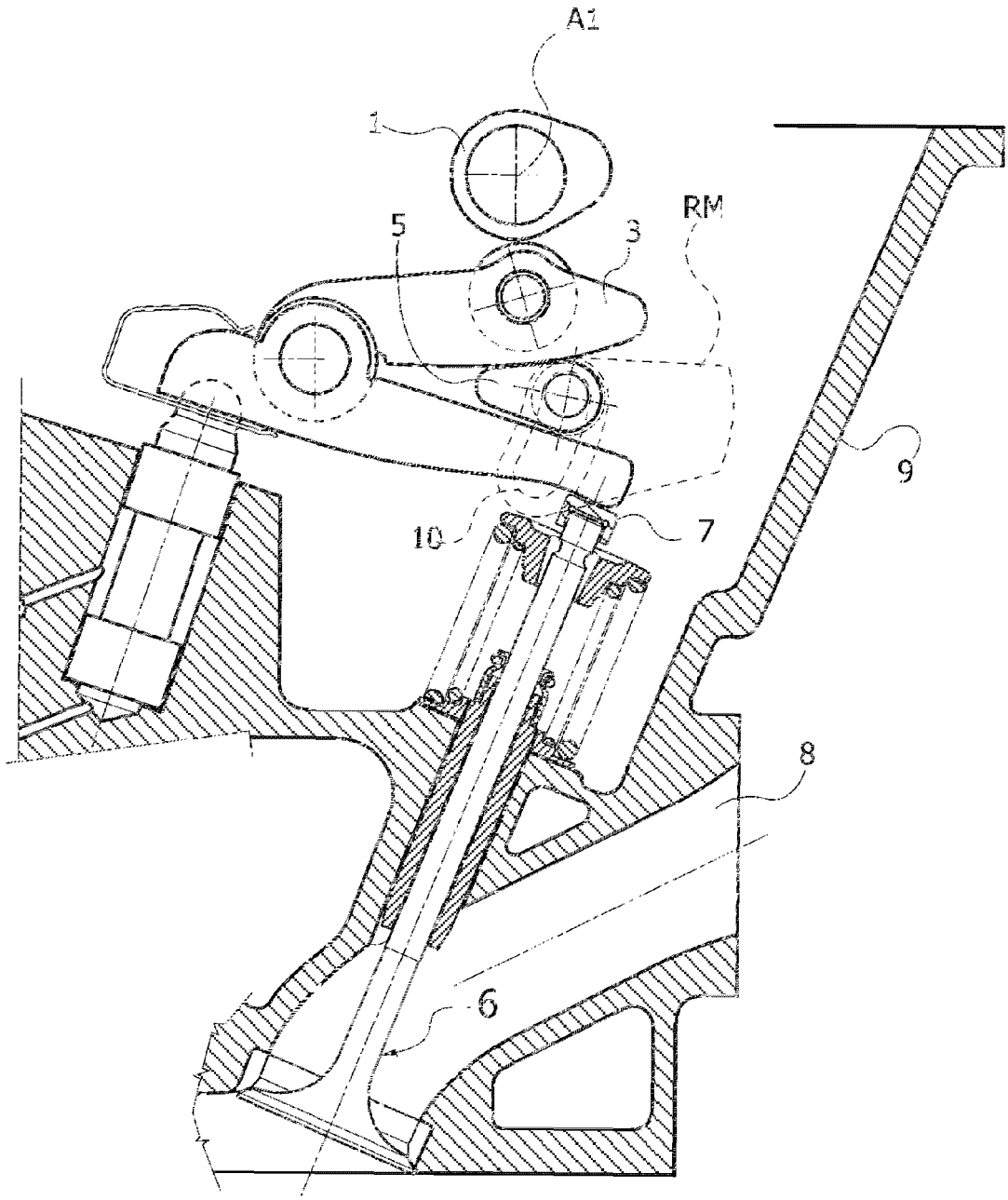
Figure 15:
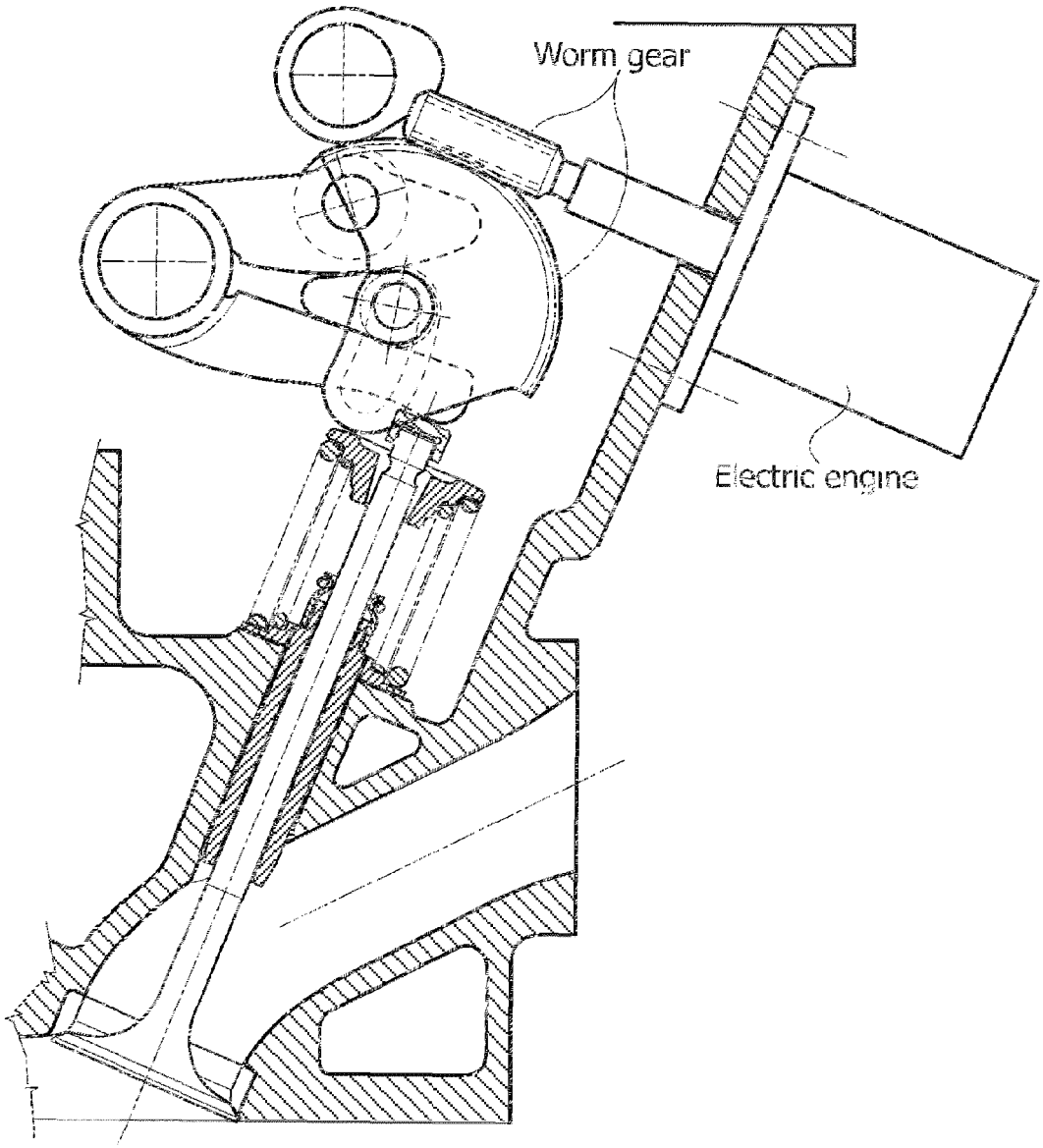

The invention will now be described, by way of example only, with reference to the enclosed figures of drawing, wherein:

FIG. 1 shows a sectional view of the arrangement described herein,

FIG. 2 is a perspective and exploded view of some components of the arrangement of FIG. 1, FIG. 3 is a perspective and sectional view of the regulator mechanism of the arrangement of FIG. 1, FIG. 4 is a longitudinal side view of the shaft of the regulator mechanism of the arrangement of FIG. 1, FIG. 5 is a schematic side view of the solution adopted to drive the regulation shaft of the arrangement of FIG. 1, FIG. 6 shows the scheme of some meaningful angular displacements of the slotted holes, with specific reference to the exemplifying conditions indicated in the following figures, FIGS. 7*a*, 7*b*, 8, 9, 10 show some meaningful operational conditions of the system, according to the VVL system to which the invention refers, FIGS. 11 and 12 show the diagrams relative to the working characteristics of the system, according to the invention, FIG. 13 is a scheme for the application of the invention for brake assist of heavy duty Diesel engines, FIG. 14 is a scheme for the application of an automatic lash compensator to the invention, and FIG. 15 is a scheme for driving individually a valve (or a group of two valves) of a cylinder or group of cylinders.

The system is composed by an actuation mechanism (AM), which actuates the variation of the lift, and by a regulation mechanism (RM), which controls the actuation mechanism, according to the defined engine control strategies.

The working principle may be understood by looking at the drawing of FIG. 1, which represents the partial sectional view of the cylinder head of a typical four cylinders—two-litre gasoline engine. The plane of the sectional view is perpendicular to the camshaft axis, and the axis of the shown poppet valve belongs to the same plane.

The following components may be identified in FIG. 1:

an actuation mechanism (AM), composed by the elements 2, 3, 4, and 5, a regulation mechanism (RM), represented in a simplified way and with dotted lines, in order to avoid confusion with overlapping drawing lines; full description later on, a camshaft 1, a shaft supporting the oscillating levers 2, a primary oscillating lever 3, with a roller 5A to reduce friction losses. A different solution could be considered (e.g. a rocker arm with cam directly acting on it or by means of a push rod, like exemplified in FIG. 13), without affecting the principle of the invention. It has to be noted that in the described example the path in contact with the slider (see FIG. 2) is not flat, in order to assure a proper contact, a secondary oscillating lever 4, a wedge-shaped slider 5, with a bore fitted with a roller, the protruding ends of which are engaged and guided by a slotted links 10 of the regulator mechanism (see FIGS. 2 and 3), a poppet intake valve 6, with springs; its axis being identified by A6, a valve cap 7, also needed to set the working clearance, an air intake port 8, a cylinder head sectional view 9, a guiding slotted holes 1 of the regulator mechanism RM, the camshaft 1 and its axis A1, an oscillating levers shaft axis A2.

FIG. 2 represents an "exploded view" of components 2, 3, 4, and 5 and shows the way in which the two oscillating levers are articulated to the shaft 2.

The schemes of FIG. 3 show the regulator mechanism RM. Corresponding to each valve 6 there are a regulator element and two guiding slotted holes 10.

In the course of the valve lift, the roller 5A slides, guided by the slotted holes like in a rail, rolling at the same time in the slider bore.

The kind of contact between the roller and the guiding slotted links is similar to that of rolling bearings, and hence the same technology shall have to be applied to minimize the friction losses and to maintain within acceptable limits the specific contact pressures (Hertz pressures).

In the illustrated example, an element with two slotted holes 10 is used for each actuated valve, the most common case being that of all the intake valves.

All these elements are part of a shaft (the regulator shaft), secured to the cylinder head by a series of bearing caps and free to rotate in both ways around its axis A3.

To be noted that the regulator shaft is a single piece in the described example, but it could also be divided in two or more segments in order to actuate them independently.

FIG. 4 represents, in a schematic way, this shaft on the bearings of the cylinder head of a four-cylinders engine.

The rotation of the regulator shaft may be operated, by way of example only, by an electric motor, driving a worm gear, shown in FIG. 5, fitted to one of its free ends. The gear may be, as in FIG. 5, limited to a sector, thanks to the not too wide angles of rotation needed. The amount of rotation is controlled by the engine Electronic Control Unit (ECU), according to defined control strategies.

This solution, although by no means excluding other ones, presents the following positive aspects:

provides the needed reduction of the transmission ratio from the electric engine to the regulation shaft, allowing in such a way to convert the relatively low torque of the electric engine to the higher torque needed to actuate the regulation shaft, the actuation of the regulation shaft, as a consequence of the above point, will be adequately fast, which is an unavoidable condition for the application of the invention to an internal combustion engine, and the actuation by means of the worm gear is such that the transmission of the actuating torque is one way (from the electric engine to the actuation mechanism, but not backward) avoiding in such a way any kind of opposing torque from the valve-train to the electric engine.

To fully understand how the system works, the following geometrical axes have to be considered see FIG. 6:

A1: is the camshaft axis,

A2: is the oscillating levers shaft axis, and

A3: is the regulator shaft axis.

The position of these axes is invariable with respect to the cylinder head body. The three shafts are secured to the cylinder head by means of bearing caps.

The oscillating levers shaft A2 is locked in place. The camshaft A1 and the regulator shafts A3 are free to rotate around its axes.

The regulator mechanism (RM) brings, for each actuated valve, an element with two guiding slotted holes, being R=A2–A3 the radius of the slotted hole centre line (see FIG. 6). It has to be noted that this characteristic it is not mandatory, because the guiding slotted holes 10 could even be of different geometry (e.g. straight). The solution here described has been chosen for reason of easier functionality and to simplify the description.

During the lift of the valve 6, the ends of the slider roller 5A slide in the two guiding slotted holes, rolling on their contact surfaces.

As already noted—in the case of the illustrated example—the primary oscillating lever contact path is not flat, to assure a proper contact with the slide. This geometry might be varied within wide limits, in order to optimize the contact pressure between the slider 5 and the oscillating levers 3, 4, as well as to obtain different kinematics and dynamic behaviours.

The working principle of the system is based on the movement of the slider 5 during the valve lift: if it slides towards A2, the angle between the oscillating levers increases and, as a consequence, also the maximum lift of the valve; if it moves away from A2, the angle decreases and also the maximum lift of the valve.

If the slider does not change its position ("neutral" position of the guiding slotted links 10), the whole group of oscillating levers 3, 4 and slider 5 rotates without relative movements and the valve maximum lift depends on the geometry of the system. As already noted, this is possible if the geometry of the guiding slotted hole is circular, with radius A2-A3 of its centre line, as may be seen in FIG. 6.

Let us consider a first angular position of the regulator (the "neutral" position), which means that the slider does not slide between the two finger oscillating levers 3, 4 when the cam acts.

In this case, as already said, the whole actuation mechanism (primary oscillating lever 3, secondary oscillating lever 4 and the slider 5) rotates like a rigid body, without relative movements of its components.

The maximum lift of the valve is only determined by the geometry of the system.

Figure 7A:
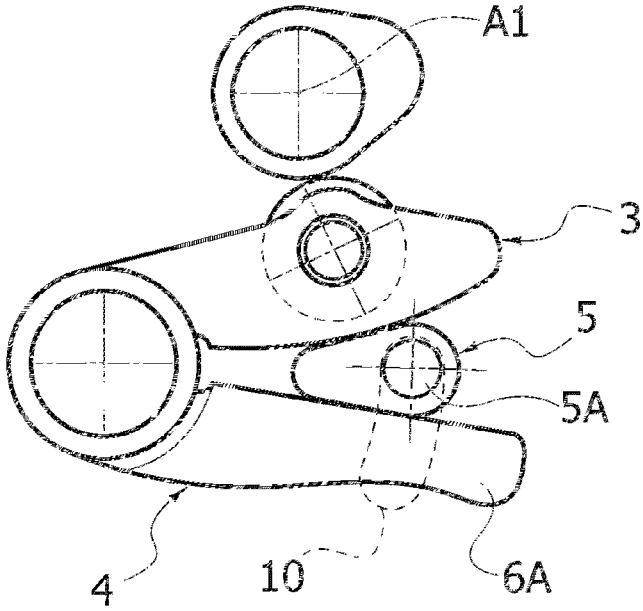
Figure 7B:
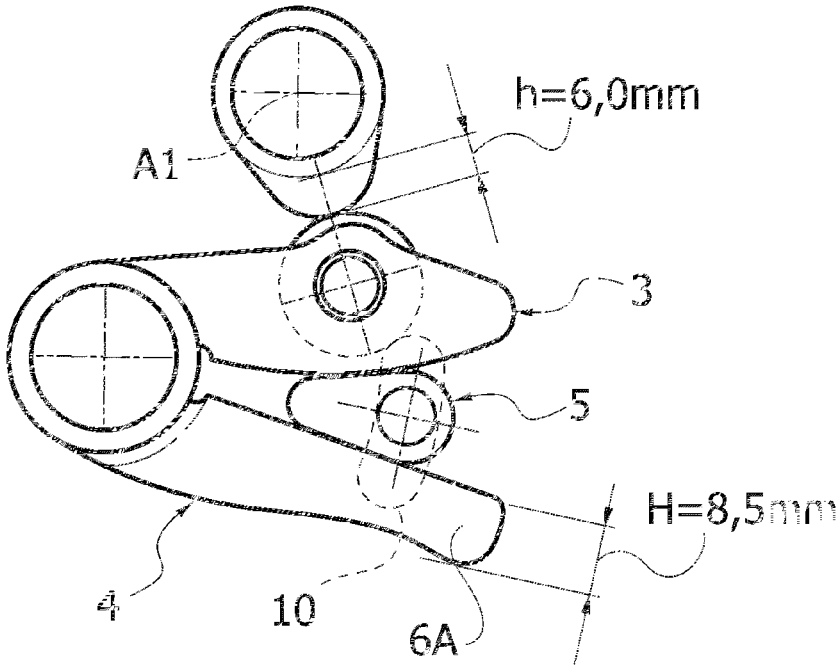
Figure 8:
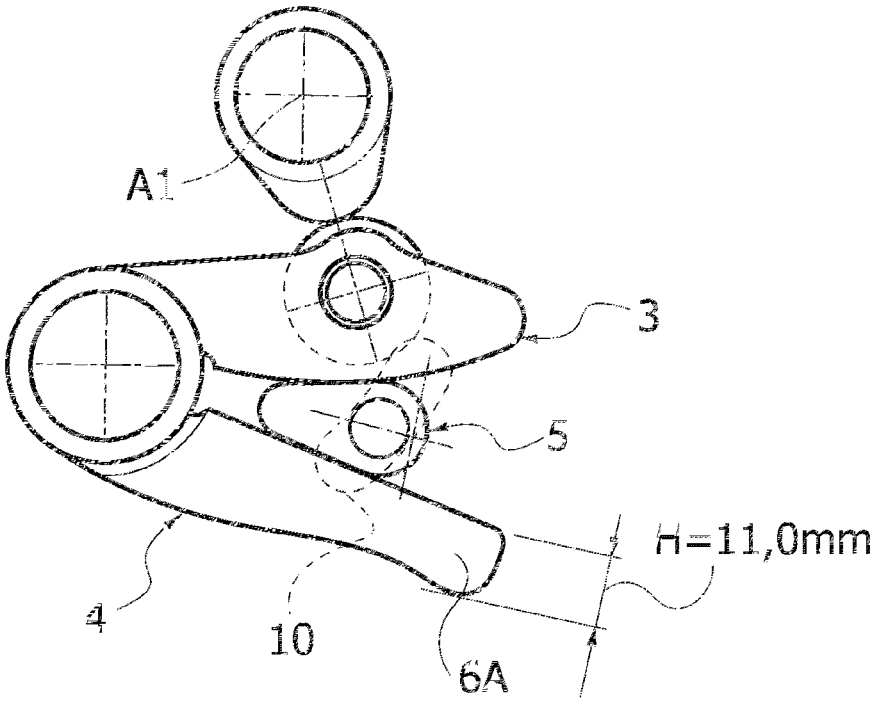
Figure 9:
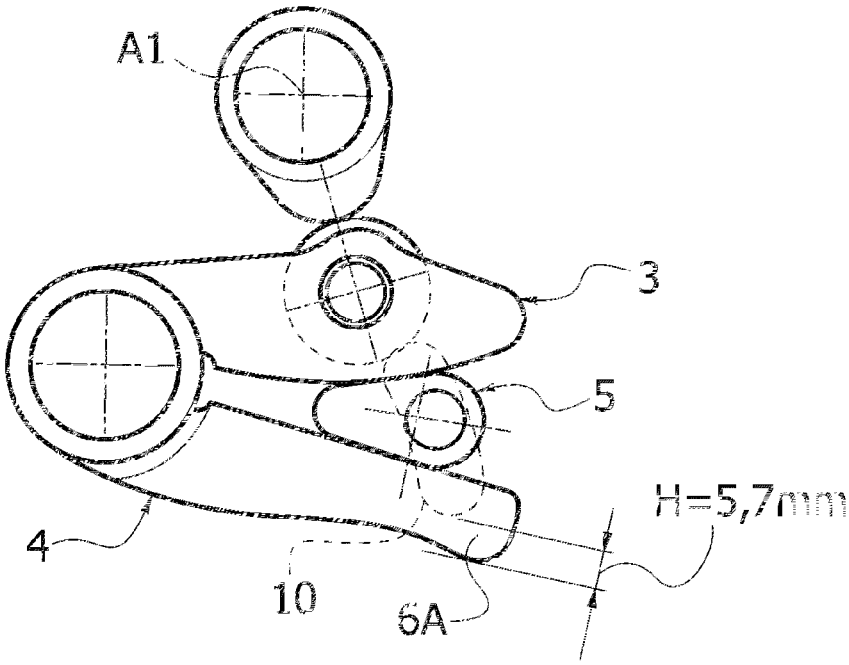

In the case illustrated in FIGS. 7*a* and 7*b*, while the maximum lift of the cam lobe is 6.0 mm, the maximum lift of the valve is about 8.5 mm.

It should to be noted that, although the scheme has to be considered purely indicative, the adopted geometry of the drawings represents a typical modern two-litre, four-cylinders spark ignition engine. So, the lift values are reasonably realistic and useful to illustrate and quantify how the system works.

As already outlined, the regulator system shaft is free to rotate around its axis. When it rotates, e.g. driven by an electric motor, also the slotted holes will rotate around axis A3 (see FIG. 6). The rotation angles are measured with reference to the straight line tangent to the centre line in A3, and the "neutral" position is assumed as the "zero point".

According to these assumptions, the system works in the following way:

if the rotation will be clockwise (−30° in the example of the scheme), the slider, in the course of the valve lift, will slide towards A2, hence increasing the angle between the two oscillating levers, and, as a consequence, the valve lift too. In the reference case (see FIG. 8) the maximum lift increases to about 11.0 mm;

if the rotation will be counter clockwise (−30° in the example of the scheme), the slider, in the course of the lift, will slide away from A2, hence decreasing the angle between the oscillating levers, and as a consequence the valve's lift too. In the reference case (see FIG. 9) the lift is reduced to about 5.7 mm.

The conclusion may be drawn that for any angular position of the regulator system there is a different value of the maximum valve lift, increasing if clockwise and decreasing if counter clockwise. In such a way the variable valve lift is obtained, in continuous way and within wide limits.

One of the possible applications of a VVL System like the one described herein is to spark ignition engines, not only for the optimization of the volumetric efficiency over the speed range, but also to control the amount Air/Fuel ratio. In such a way, the throttle valve may be eliminated and, in fact, the only solution with continuous variation of the lift on the market (BMW VALVETRONIC) works in this way, although the throttle valve has been kept for safety reasons, in case of trouble of the main system.

By reducing the maximum lift of both the intake valves of a cylinder (with proper design of the air intake manifolds) there also is the benefit to increase—at engine part load—the level of "tumble" (the turbulence around an axis perpendicular to the cylinder axis) of the intake air, which is of interest for modern spark ignition engines, and particularly in the case of Gasoline Direct Injection (GDI).

Alternatively, the maximum lift of one of the two intake valves may be varied for the modulation of the induced air swirl, which is of particular interest for the Diesel engines, but also for spark ignition ones.

Of course, managing the valves in such a way requires a modified regulator's mechanism, acting independently on the two air intake valves of each cylinder.

Another application of interest for both gasoline and Diesel engines is the modulation of the internal. Exhaust Gas Recirculation (EGR), by varying the maximum lift of the exhaust valves.

Moreover, the application of the invention to the exhaust valves of heavy duty Diesel engines could give the possibility to obtain a "servo braking" or "retarder" effect, by regulating the exhaust valves to small lifts when braking.

An example, by no way limitative, of such application may be seen in FIG. 13, which schematically represents the VVL System applied to the exhaust valves of a heavy duty Diesel engine. In this case, the secondary oscillating lever is a rocker arm, while the primary one is actuated, as it is common in many H.D. Diesel engines, by a push rod.

Has to be noted that the same solution might be adopted in other engines, where it is important not to increase the height of the cylinder head. This is often the case of gasoline engines, where—being the push rod solution outdated, although still in production—a cam, instead of a push rod—could act directly on the primary oscillating lever.

Since, in order to obtain the function of brake assist, the exhaust valves lift shall have to be very rapidly reduced to small value when braking, a continuous variation of the valve lift might not be needed. In this case, the regulator mechanism could be actuated by a switching system (e.g. electromagnetic), capable to rotate counter-clockwise the regulator mechanism to a defined position, like A, as shown in FIG. 13.

As a further option, the counter clockwise rotation may be brought up to "lift zero", which will keep the valve always closed (FIG. 10—cylinder deactivation).

This option may be used to get the "modular working" of the engine, which means the possibility, when working at part load, to deactivate some of the working cylinders (e.g. 4 cylinders of a V8), by keeping its intake and exhaust valves always closed.

In this way the active cylinders will work with higher efficiency, with benefits on the emissions too. This could be considered a sort of "variable displacement engine" and a few models of cars with this solution are already in production.

This application is typically on spark ignition engines, but it has also been considered for Diesels to speed up the warm up, and hence reduce emissions, by running the Engine after the cold start with half of the cylinders deactivated (the active cylinders will work at higher load and temperatures).

Of course, the re-activation phase of the cylinder shall have to be performed with proper phasing, in order to avoid heavy impact of the primary follower arm with the cam.

Has to be noted that, when deactivating a cylinder, the friction losses of the excluded valve trains are reduced to a minimum, because—when there is no valve lift—the cam will rotate without pushing on the follower.

This is not the case with other variable valve lift solutions, e.g. some of the electro—hydraulic types, which increase the parasitic losses in the deactivation mode, due to pumping of the maximum flow of the oil by-passed by the controlling electro-valve.

FIG. 11 shows the lift of the valve versus the camshaft degrees of rotation, for the four considered cases (+30°, neutral or zero, −30°, −95°).

Looking at the variation of the lift allowed by this solution, the following aspects are worth to be mentioned:

with zero valve lash, the lift starts and ends at the same cam angle for any position of the regulator shaft;

once the working clearance is applied to the valve-train, if the maximum lift is reduced, the lift starts later and ends earlier, and the opposite when increasing (of course this is not true if an automatic lash compensator is used).

It is well known that this kind of variation of the start/closing phasing of the valve actuation is what is needed for the optimisation of both the full load volumetric efficiency and the part load working of the engine.

the lift behaviour is not only symmetric (of course, if the cam is symmetric), but—with proper design—also proportional, which means that the lift curve determined by a position of the regulator shaft may be derived from the curve corresponding to another position of the shaft by multiplying the lifts by a constant factor. This aspect (which is valid for the exemplified geometry of the system) could greatly simplify the software of the control system.

The above-mentioned characteristics differentiate this patent from most of the solutions of continuous variable valve lift known.

FIG. 12 shows the maximum lift versus the regulator shaft degrees of rotation. It may be seen that the relationship is about linear.

By specific design of the system geometry, different behaviours are possible, like The one indicated with a dotted line, which asks for lower regulator shaft angles of rotation. Non-linear behaviour is also possible by means of proper design.

As already said, the rotation of the regulator shaft may be operated by an electric motor driving a worm gear, fitted to one free end of the shaft, or even in an intermediate position, if the cylinder head layout will allow it.

Has to be noted that there are already on the market OEM solutions to drive and control such kind of system (e. g. Variable Valve Lift Control by VDO—Siemens) and this could greatly simplify the application, as well as minimize costs and time to market.

Alternative systems could be used to operate the regulator mechanism, but this is out of the scope of this invention, being a typical field of application for the Manufacturers of Automotive Components.

The system could also be conceived, with added complication and cost, to individually drive the valves of each cylinder. This implies independent regulator shafts and driving systems for each valve or group of valves.

FIG. 14 shows an example—by no means limitative—of such application. The case of both oscillating levers controlled by the lash compensator is shown. In this case, the oscillating levers of the various cylinders do not need a supporting shaft, but those corresponding to a valve are hinged together by a connecting pin.

Other solutions are possible, depending on the kind of lash compensator considered.

This solution, although more complex, is of great interest due to the full flexibility allowed. To be outlined that, in this case, the increased complexity—due to the actuators individual operation on each valve or group of valves—is more than compensated by the low power required by the individually driving electric engines. In fact, in this case, the rotation of the regulation shaft may be performed only when the valve is in its closed position (corresponding to a cam base circle of about 240 cam degrees) and the opposing torque is only due to the friction and inertia forces, both very low. In a few engine revs even the widest rotation will be actuated and, moreover, the regulation will be faster. This means that the sum of the power of the small electric engines driving the shafts of the individual regulator mechanisms needed for an engine may be much lower than the power of a single bigger electric engine driving the common regulator shaft for all the valves, since, in this case, there will always be the opposing torque due to the lift phase of some valves. FIG. 15 schematically represents how each valve (or group of two valves) may be driven by a single low power electric motor through a small worm gear. The gear may be derived from one of the two "shoulders" or sidewalls of the element with slotted holes.

Finally, it should be noted that, although the "oscillating levers and wedge shaped slider principle" should bring some additional friction losses (widely compensated by the possibility of working most of the time with low valve lifts, which means lower spring load and reduced friction losses from the contact between the cam and the follower), however said mechanical solution could also perform some positive "vibration dampening effect" (basically any cam actuated valve train is a pulsating system).

Consequently, without prejudice to the underlying principles of the invention, the details and the embodiments may vary, also appreciably, with reference to what has been described by way of example only, without departing from the scope of the invention as defined by the annexed claims.

The mechanical system herewith described could also find applications different from the variation of internal combustion engine valves lift and could be considered applicable wherever the conversion of a rotary motion to a rectilinear alternative one with variable amplitude is needed.

The invention claimed is:

1. An internal combustion engine including:

at least one cylinder, at least one air intake valve and at least one exhaust valve for said at least one cylinder, each valve being equipped with a return elastic device, with the function of keeping each valve in a closed position, in order to control the flow of a corresponding manifold, at least one camshaft, to operate said at least one air intake valve and said at least one exhaust valve by acting on at least one of followers and tappets of said at least one air intake valve and said at least one exhaust valve, at least one valve, operated by cams of said at least one camshaft by means of an electronically controlled variable mechanical transmission configured to vary the maximum lift of each valve when changing a working condition of the engine, said electronically controlled variable mechanical transmission interposed between each valve and a corresponding actuating cam of the cams of said at least one camshaft, wherein said variable mechanical transmission, comprises with reference to each actuated valve actuated, by said actuating cam:

a regulation mechanism including at least one guiding slotted hole, a primary oscillating lever, directly operated by the corresponding cam, a secondary oscillating lever to transmit the movement to said each actuated valve, a wedge-shaped slider device, with a bore fitted with a roller, free to rotate around an axis of said bore, protruding ends of said roller engaging in said guiding slotted holes; said slider being interposed between the corresponding primary and secondary oscillating levers, to transmit the movement from one to the other, a driving system to operate said regulation mechanism together with its guiding slotted holes, in order to change the position of the slider with respect to said primary and secondary oscillating levers, at the same time varying the characteristic of transmission from said cam to said each actuated valve.

2. The engine according to claim 1, wherein said regulation mechanism (RM) includes a regulation shaft assembled free to rotate around an axis, in order to permit a variation of the position of said guiding slotted holes around the same axis.

3. The engine according to claim 2, wherein said regulation shaft comprises more regulation parts, each of said regulation parts regulating corresponding valves of the engine, each regulation part including two walls perpendicular to the regulation shaft, said walls presenting two guiding slotted holes facing each other, in which the ends of said roller are engaged such that parts of said roller protrude from both the lateral sides of the slider bore.

4. The engine according to claim 1, wherein said primary oscillating lever is assembled free to oscillate around the axis, parallel to the axis of said camshaft, and works coupled to the cam of said camshaft.

5. The engine according to claim 4, wherein said oscillating lever is assembled free to rotate around said axis being hinged to it by one of its ends.

6. The engine according to claim 5, wherein said primary oscillating lever is fitted with a roller, free to rotate, in contact with the corresponding cam of the camshaft.

7. The engine according to claim 1, wherein said secondary oscillating lever is assembled free to oscillate around an axis (A2) parallel to the axis (A1) of said camshaft, being hinged by one of its ends to the shaft.

8. The engine according to claim 7, wherein the primary and the secondary oscillating levers, being articulated to the same shaft, are configured to oscillate around the axis parallel to the axis of said camshaft.

9. The engine according to claim 7, wherein the primary and secondary oscillating levers are hinged to two distinct and parallel shafts.

10. The engine according to claim 1, wherein at least one of the primary oscillating lever and the secondary oscillating lever are not hinged to a shaft and have one of their ends pivoted by an hydraulic lash adjuster.

11. The engine according to claim 1, wherein the body of said slider is substantially shaped like a wedge, with two opposite converging surfaces working in contact respectively with the primary and the secondary oscillating lever, said wedge shaped element comprising two side limiting walls, and the body of the slider having a bore with its axis parallel to that of the actuator shaft and also having a roller fitted in said hole, free to rotate, and with one or both of its ends protruding from the slider body to be engaged by the slotted holes.

12. The engine according to claim 1, wherein the rotation of said regulation mechanism (RM) is actuated by an electric engine through a worm gear, which transforms the rotation of the electric engine shaft in an angular rotation of the regulation mechanism around the regulation axis.

13. The engine according to claim 12, wherein said worm gear, acting between the electric engine and the regulation mechanism shaft, includes a worm wheel and a helical gear, or sector of helical gear, with their axis being orthogonal.

14. The engine according to claim 1, wherein the shape and the disposition of the parts are such that an angular rotation of said slotted holes around the regulation axis causes a variation of the maximum lift of the corresponding valve, according to a quasi-linear characteristic of transmission.

15. The engine according to claim 1, wherein a Variable Valve Timing solution is used with the invention by the transmission.

16. The engine according to claim 1, wherein the engine is applied to an internal combustion engine to vary the amount of air aspirated in order to keep the Air/Fuel ratio within defined limits.

17. The engine according to claim 1, wherein the engine is applied to vary the turbulence of the air in the combustion chamber.

18. The engine according to claim 1, wherein the engine is used to reduce the lift of the exhaust valves when braking the vehicle, in order to realize a servo braking effect.

19. The engine according to claim 1 wherein the engine is used to vary the lift of the exhaust valves in order to modulate the internal Exhaust Gas Recirculation.

20. The engine according to claim 1, wherein the engine is used to deactivate one or more cylinders of the engine by reducing the intake and exhaust valves lifts to zero.

21. The engine according to claim 1, wherein said each actuated valve comprises a plurality of actuated valves and said at least one cylinder comprises a plurality of cylinders, the regulator mechanism acts simultaneously by means of a single shaft on the actuation mechanisms of the plurality of actuated valves of all the cylinders of the plurality of cylinders.

22. The engine according to claim 1, further comprising independently working actuators systems for the actuated valves of each cylinder or group of cylinders of said at least one cylinder and the individual driving units are used for each cylinder or group of cylinders of said at least one cylinder, and there is an independently working regulator shaft for each cylinder or group of cylinders of said at least one cylinder.

* * * * *